US007084851B2

(12) United States Patent
Yamasaki

(10) Patent No.: US 7,084,851 B2
(45) Date of Patent: Aug. 1, 2006

(54) DISPLAY DEVICE HAVING SRAM BUILT IN PIXEL

(75) Inventor: Nobuo Yamasaki, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 618 days.

(21) Appl. No.: 09/989,027

(22) Filed: Nov. 21, 2001

(65) Prior Publication Data

US 2002/0060660 A1 May 23, 2002

(30) Foreign Application Priority Data

Nov. 22, 2000 (JP) ..... 2000-356132

(51) Int. Cl.
*G09G 3/36* (2006.01)

(52) U.S. Cl. ..... 345/98; 345/96; 345/97; 345/99; 345/100

(58) Field of Classification Search ..... 345/92, 345/96, 98, 103, 55, 87, 90, 100, 108, 211–214, 345/99

See application file for complete search history.

(56) References Cited

U.S. PATENT DOCUMENTS 5,471,225 A * 11/1995 Parks ..... 345/98
5,534,884 A * 7/1996 Mase et al. ..... 345/87
5,712,652 A * 1/1998 Sato et al. ..... 345/90
5,739,804 A * 4/1998 Okumura et al. ..... 345/99
5,831,418 A * 11/1998 Kitagawa ..... 323/222
5,867,138 A * 2/1999 Moon ..... 345/92
5,875,034 A * 2/1999 Shintani et al. ..... 358/296
5,977,940 A * 11/1999 Akiyama et al. ..... 345/94
6,166,714 A * 12/2000 Kishimoto ..... 345/96
6,452,579 B1 * 9/2002 Itoh et al. ..... 345/100
6,522,319 B1 * 2/2003 Yamazaki ..... 345/103
6,636,194 B1 * 10/2003 Ishii ..... 345/98
6,778,162 B1 * 8/2004 Kimura et al. ..... 345/90
6,803,896 B1 * 10/2004 Senda et al. ..... 345/98
6,850,217 B1 * 2/2005 Huang et al. ..... 345/97
2002/0075211 A1 * 6/2002 Nakamura ..... 345/87
2005/0041117 A1 * 2/2005 Yamagishi ..... 348/231.2

FOREIGN PATENT DOCUMENTS

JP 58-143389 * 8/1983 ..... 3/36

* cited by examiner

*Primary Examiner*—Bipin Shalwala
*Assistant Examiner*—Prabodh Dharia
(74) *Attorney, Agent, or Firm*—Oblon, Spivak, McClelland, Maier & Neustadt, P.C.

(57) ABSTRACT

Disclosed is a technology of further reducing power consumption while a display device having an SRAM built therein is being driven based on data held in the SRAM. A power source voltage control circuit is provided in a power source voltage generating unit for supplying a power source voltage to a data driver and a scan driver of the display device. During a period when graphic data held in the SRAM is supplied to a pixel and a display is performed, the supply of the power source voltage from the power source voltage control circuit is stopped, and operations of the data driver and the scan driver are stopped.

25 Claims, 4 Drawing Sheets

NORMAL DISPLAY MODE
WRITE MODE
SRAM DISPLAY MODE
DURING BLACK DISPLAY
PIXEL ELECTRODE
ANALOG POTENTIAL
OPPOSITE ELECTRODE
DURING WHITE DISPLAY
PIXEL ELECTRODE
ANALOG POTENTIAL
OPPOSITE ELECTRODE
H
L
H
L
H
L
H
L
PIXEL TFT on/off off off

FIG.4

| CIRCUIT CONFIGURATION | POWER SOURCE VOLTAGE VDD | VSS | SRAM DRIVE |
|---|---|---|---|
| · X DRIVER<br>SHIFT REGISTER<br>DATA LATCH<br>GRADATION VOLTAGE SELECTION UNIT<br>SIGNAL LINE OUTPUT UNIT | XVDD | GND | UNREQUIRED |
| · Y DRIVER | | | |
| SHIFT REGISTER | YVDD | GND | REQUIRED |
| LEVEL SHIFTER | YGVDD | YGVSS | REQUIRED |
| SCAN LINE OUTPUT UNIT | YGVDD | YGVSS | REQUIRED |
| · SRAM DRIVER | | | |
| SRAM CONTROL SIGNAL GENERATING UNIT | YGVDD | YGVSS | REQUIRED |
| SRAM INVERTER POWER SOURCE UNIT | SVDD | SVSS | REQUIRED |

DISPLAY DEVICE HAVING SRAM BUILT IN PIXEL

CROSS REFERENCE TO RELATED APPLICATION

This application is based upon and claims the benefit of priority under 35 USC § 119 to Japanese Patent Application No. 2000-356132, filed on Nov. 22, 2000; the entire contents of which are incorporated herein by reference.

BACKGROUND OF THE INVENTION

1. Field of the Invention

The present invention relates to an active matrix type display device having an SRAM in a pixel. More specifically, the present invention relates to a circuit technology reducing a power loss caused during display of a still image by graphic data held in the SRAM.

2. Description of the Related Art

As a memory device capable of statically holding graphic data in one pixel, an active matrix type liquid crystal display device having an SRAM built therein (hereinafter, referred to as an SRAM-built-in liquid crystal display device) is developed.

Generally, in a liquid crystal display device without the SRAM built therein, still image data is given to each frame, thus displaying a still image. Since a driver, a graphic controller and the like continuously operate during the display, it is difficult to reduce power consumption. Meanwhile, in the SRAM-built-in liquid crystal display device, a still image is displayed based on the still image data held in the SRAM (hereinafter, referred to as SRAM holding data). Since the driver, the graphic controller and the like are on standby during the display, the power consumption can be reduced. As documentation disclosing this type of liquid crystal display device, there is U.S. Pat. No. 5,712,652. Here, described is a liquid crystal display device including a digital memory cell as a memory device for each pixel.

During the display of the still image based on the SRAM holding data, it is unnecessary to supply a power source voltage to circuits of the driver, the graphic controller and the like on standby. In the conventional SRAM-built-in liquid crystal display device, since the power source voltage has been supplied to the entire circuits even on standby, the power loss has occurred inside the circuits on standby.

A similar power loss occurs also in a DC/DC converter supplying the power source voltage to the driver, the graphic controller and the like. The DC/DC converter is constituted of a switching regulator or a series regulator. Therefore, even if a load thereto is almost zero, a self loss of such a regulator is caused, leading to a power loss for this amount.

In many cases, the SRAM-built-in liquid crystal display device is used as a display of a portable information apparatus driven by a battery. Hence, a wasteful power loss causes a battery life to be shortened. From the background as described above, for the SRAM-built-in liquid crystal display device, required is further reduction of the power consumption during the display of the still image based on the SRAM holding data.

BRIEF SUMMARY OF THE INVENTION

The object of the present invention is to further reduce the power consumption during a drive of the SRAM-built-in display device based on the SRAM holding data.

A first feature of the display device according to the present invention is a display device including a memory device-built-in pixel portion including a plurality of data lines and a plurality of scan lines arranged in a matrix, a plurality of pixels disposed on respective intersections of the both lines, a plurality of pixel switching elements electrically conducting the data lines and the pixels based on scan signals supplied to the scan lines to write graphic data supplied to the data lines into the pixels, and a plurality of memory devices storing the graphic data supplied to the data lines and being constituted to be capable of supplying the graphic data stored to the pixels corresponding thereto, a data driver and a scan driver for controlling the write of the graphic data supplied to the data lines into the pixels in order to perform a first display, a memory device driver for controlling the write of the graphic data held in the memory devices into the pixels in order to perform a second display, a power source voltage generating unit for supplying a power source voltage to the data driver and the scan driver, and a power source voltage control circuit for stopping a supply of the power source voltage from the power source voltage generating unit during a period of the second display.

A second feature of the display device according to the present invention is a display device including a memory device-built-in pixel portion including a plurality of data lines and a plurality of scan lines arranged in a matrix, a plurality of pixels disposed on respective intersections of the both lines, a plurality of pixel switching elements electrically conducting the data lines and the pixels based on scan signals supplied to the scan lines to write graphic data supplied to the data lines into the pixels, and a plurality of memory devices storing the graphic data supplied to the data lines and being constituted to be capable of supplying the graphic data stored to the pixels corresponding thereto, a data driver and a scan driver for controlling the write of the graphic data supplied to the data lines into the pixels in order to perform a first display, a memory device driver for controlling the write of the graphic data held in the memory devices into the pixels in order to perform a second display, a power source voltage generating unit for supplying a power source voltage to the data driver and the scan driver, and a power source voltage generating and stopping circuit for stopping generation of the power source voltage in the power source voltage generating unit during a period of the second display.

BRIEF DESCRIPTION OF THE DRAWINGS

FIG. 4 is an explanatory view showing relations of circuit configurations of an X driver, a Y driver and an SRAM driver for driving the SRAM-built-in pixel unit, a power source voltage for use and a power source voltage during the SRAM drive toward using conditions thereof.

DETAILED DESCRIPTION OF THE INVENTION

Hereinafter, description will be made for an embodiment in which a display device according to the present invention is applied to a liquid crystal display device.

Figure 1:
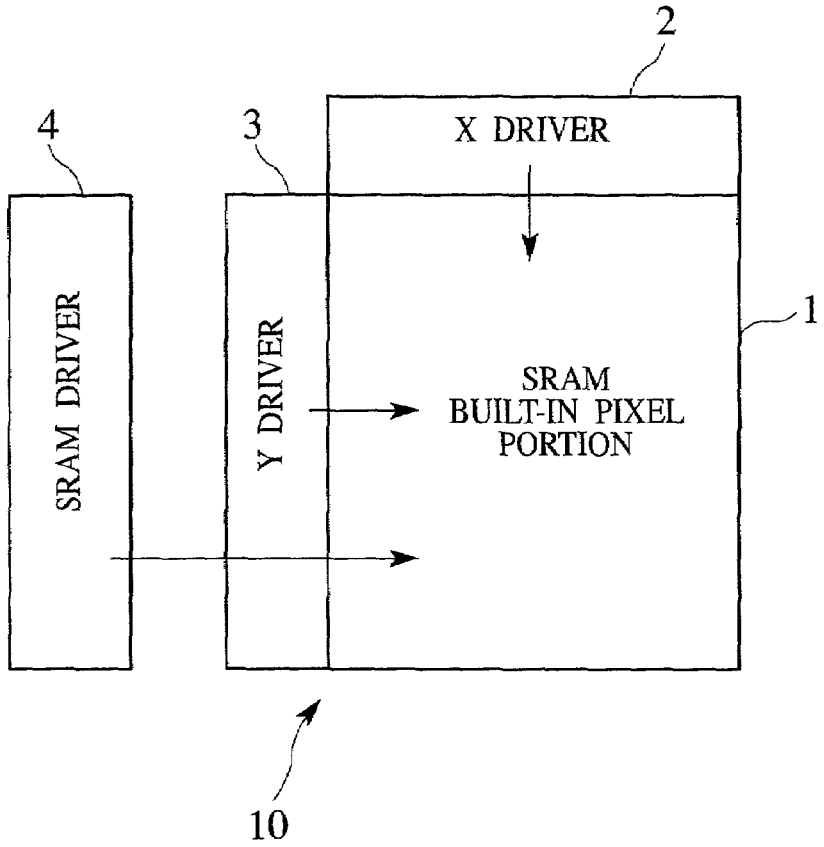
FIG. 1 is a block diagram schematically showing a configuration of a liquid crystal display device according to an embodiment.

FIG. 1 is a block diagram schematically showing a configuration of a liquid crystal display device 10 according to the embodiment. The liquid crystal display device 10 includes: an SRAM-built-in pixel portion 1; an X driver 2 and a Y driver 3 for normally driving the SRAM-built-in pixel portion 1; and an SRAM driver 4 for driving the SRAM-built-in pixel portion 1 based on SRAM holding data.

Besides a power source voltage, a timing signal, graphic data and various control signals are supplied to each of the drivers according to needs from an I/F substrate including a controller IC, a power source voltage generating unit, a D/A converter and the like, which are not shown.

Note that, the X driver 2, the Y driver 3 and the SRAM driver 4 are a data driver, a scan driver and a memory device driver in this embodiment, respectively. The SRAM-built-in pixel portion 1 is a memory device-built-in pixel unit in this embodiment. The controller IC is an external control circuit in this embodiment.

Figure 2:
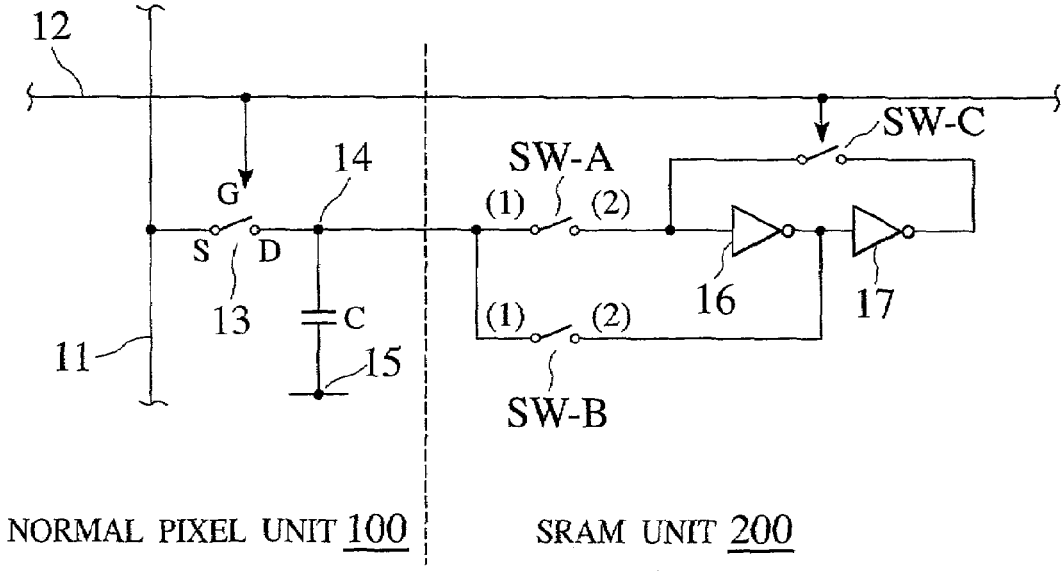
FIG. 2 is a circuit configuration diagram showing in detail a configuration of one pixel included in an SRAM-built-in pixel unit shown in FIG. 1.

FIG. 2 is a circuit configuration diagram showing in detail a configuration of one pixel included in the SRAM-built-in pixel portion 1 shown in FIG. 1. Reference codes added to a switch shown in FIG. 2 collectively denote a thin film transistor (TFT) switch such as an (n-channel or p-channel) MOSFET. Hence, two terminals and one contact of the switch denote a source (S), a drain (D) and a gate (G), respectively.

One pixel is constituted of a normal pixel unit 100 and an SRAM unit 200. The normal pixel unit 100 is a pixel area without any memory device, and is constituted of a pixel TFT 13, a pixel electrode 14, an opposite electrode 15, a liquid crystal layer (not shown) and the like. In other words, the pixel shown in FIG. 2 is a liquid crystal pixel holding the liquid crystal layer (not shown) between the pixel electrode 14 and the opposite electrode 15.

In the normal pixel unit 100, the source of the pixel TFT 13 is connected to a data line 11, and the drain is connected to the pixel electrode 14. The liquid crystal layer (not shown) is held between the pixel electrode 14 and the opposite electrode 15, thus forming a pixel capacitor C. Moreover, the gate of the pixel TFT 13 is connected to a scan line 12, and on/off thereof is controlled by a scan signal supplied from the Y driver 3 shown in FIG. 1. A potential of the scan line 12 is set at an off-level or an on-level based on the scan signal supplied from the Y driver 3.

Note that the pixel TFT 13 is a pixel-switching element in this embodiment. Moreover, though not shown, the data line 11 and the scan line 12 exist in plurality, respectively, and are arranged in a matrix. And, the pixel shown in FIG. 2 is disposed on each intersection of the both lines.

The SRAM unit 200 is an area constituting the SRAM as a memory device and is constituted of switches SW-A, SW-B and SW-C and inverters 16 and 17. In the SRAM unit 200, a terminal (2) of the switch SW-A is connected to an input side of the inverter 16, and an output side of the inverter 16 is connected to an input side of the inverter 17 and a terminal (2) of the switch SW-B. Moreover, an output side of the inverter 17 is connected via the switch SW-C to the input side of the inverter 16. The pixel electrode 14 of the normal pixel unit 100 is connected to terminals (1) of the switches SW-A and SW-B of the SRAM unit 200.

In the SRAM unit 200, the inverters 16 and 17 and the switch SW-C constitute the SRAM. The switches SW-A and SW-B constitute a switching circuit controlling electric conduction between the pixel electrode 14 of the normal pixel unit 100 and the SRAM. Moreover, the switch SW-C in the SRAM is an SRAM switching element in this embodiment.

The gates of the switches SW-A and SW-B are connected to control signal lines (not shown), and on/off thereof is controlled by control signals supplied via the control signal lines from the SRAM driver 4 shown in FIG. 1. Moreover, the gate of the switch SW-C is connected to the scan line 12, and on/off thereof is controlled by the scan signal supplied from the Y driver 3 shown in FIG. 1. In other words, the on/off of the pixel TFT 13 and the switch SW-C is controlled by the scan signal supplied to the same scan line 12. However, the on/off of the pixel TFT 13 and the on/off of the switch SW-C are in a relation reverse to each other. Specifically, when the pixel TFT 13 is turned on, the switch SW-C is turned off, and when the pixel TFT 13 is turned off, the switch SW-C is turned on.

Note that, in FIG. 2, the inverters 16 and 17 connected to the switch SW-C are constituted of CMOS gates.

In this embodiment, the display of a still image based on the graphic data held in the SRAM unit 200 (i.e., SRAM holding data) is referred to as an SRAM drive. Moreover, a display of a full-color moving picture or a halftone image based on the graphic data supplied to the data line 11 is referred to as a normal drive. The display based on the normal drive is a first display in this embodiment, and the display based on the SRAM holding data is a second display in this embodiment.

Figure 3:
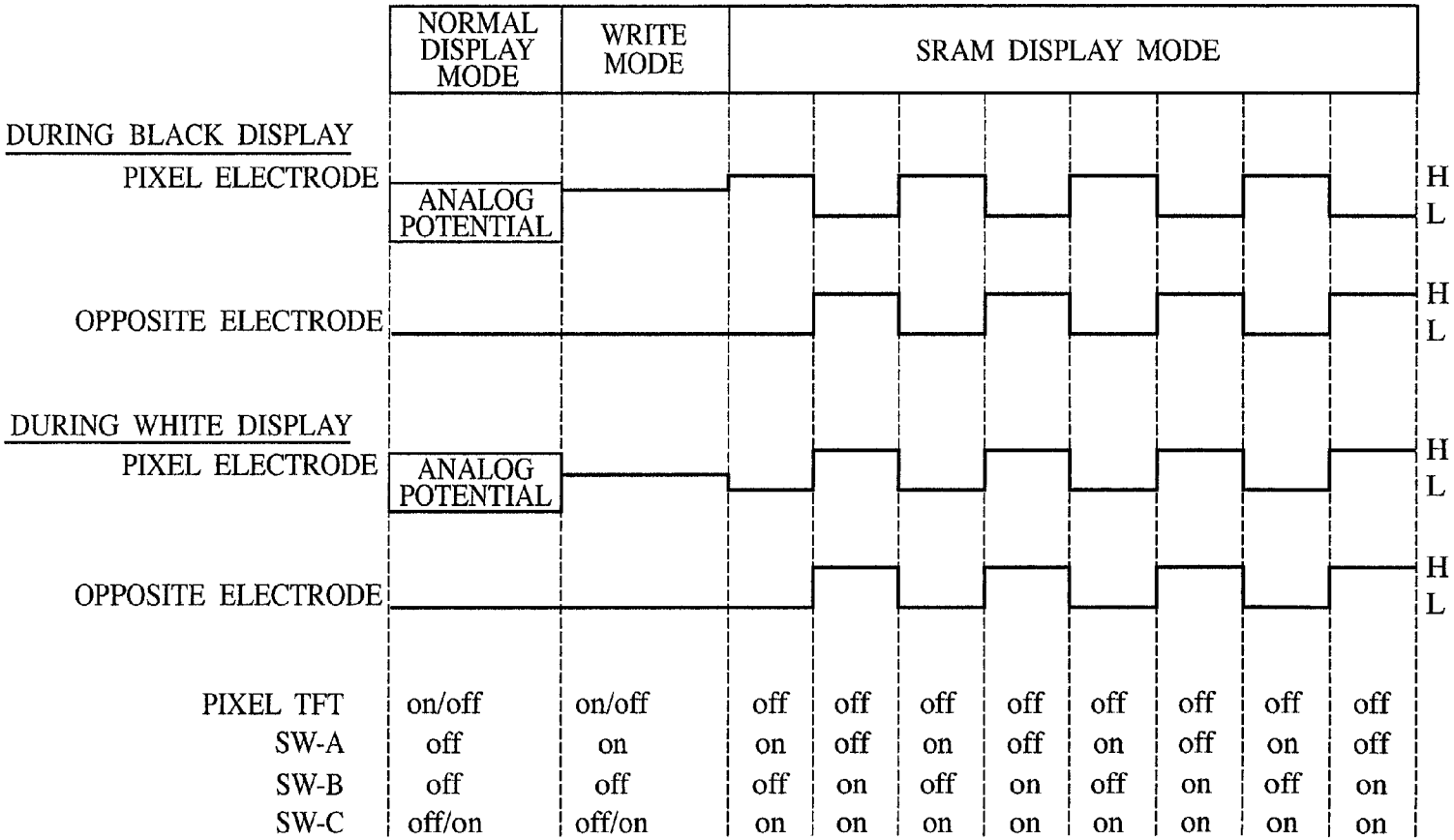
FIG. 3 is a time chart showing change of a signal voltage during an SRAM drive.

Next, description will be made for a basic operation of the pixel described above with reference to FIG. 3. FIG. 3 is a time chart showing change of s signal voltage during the SRAM drive. Dotted lines indicate partitions of frames. Moreover, "H" and "L" in each signal voltage denotes potentials on high and low levels, respectively. For example, a potential of 10 V as "H" and a potential of 5 V as "L" are set.

In a normal display mode where the pixel is normally driven, the switches SW-A and SW-B are turned off, and the SRAM unit 200 and the normal pixel unit 100 are cut separately from each other, then the display is performed by the on/off of the pixel TFT 13. In other words, the pixel TFT 13 is iterated to be on/off in a set cycle by the scan signals supplied via the scan line 12 from the Y driver 3, and normal graphic data is applied to the pixel capacitor C via the data line 11 from the X driver 2 in synchronization with the scan signals, thus performing the display.

In the case of the SRAM drive, in a final frame switched from the normal drive to the SRAM drive (i.e., in a write mode), the SRAM holding data is written into the SRAM unit 200. In this write mode, the switch SW-A is turned on, the switch SW-B is turned off, and the pixel TFT 13 and the switch SW-C are iterated to be on/off in a set interval. Then, a binary monochrome signal voltage is supplied via the data line 11 from the X driver 2 and written into the inverters 16 and 17 as SRAM holding data.

In the following SRAM display mode performing the SRAM drive, the pixel TFT 13 is fixed to be off, and the switch SW-C is fixed to be on. Moreover, the switch SW-A and SW-B are iterated to be on/off alternately for each frame cycle, and outputs of the inverters 16 and 17 (i.e., reverse and non-reverse outputs) are alternately selected, thus the SRAM holding data different in polarity for each frame cycle is given to the pixel capacitor C. In synchronization therewith, a potential of the opposite electrode 15 is reversed for each frame cycle. Consequently, a binary monochrome display is obtained from a phase relation between the potential of the pixel electrode and the potential of the opposite electrode.

FIG. 4 is an explanatory view showing relations of circuit configurations of the X driver 2, the Y driver 3 and the SRAM driver 4 for driving the SRAM-built-in pixel portion 1 shown in FIG. 1, a power source voltage for use and a power source voltage during an SRAM drive toward using conditions thereof. Hereinafter, description will be briefly made for an operation of each unit with reference to FIG. 4. Note that each unit described in FIG. 4 is not illustrated. Moreover, a term such as "power source voltage XVDD" is abbreviated as "XVDD".

The X driver 2 includes a shift register, a data latch, a gradation voltage selection unit and a data line output unit. Parallel graphic data (i.e., digital gradation data) for each of R, G and B inputted to the X driver 2 is converted into a serial data string for one line in the shift register and the data latch. A gradation voltage of this graphic data is converted into analog graphic data by the gradation voltage selection unit. Furthermore, the converted analog graphic data is subjected to impedance conversion in the data line output unit, and then outputted to the data line 11.

The Y driver 3 includes a shift resister, a level shifter and a scan line output unit. A shift pulse inputted to the Y driver 3 is shifted at timing of a clock signal in the shift register. This shift pulse is subjected to level conversion in the level shifter, and then outputted as a scan signal from the scan line output unit to the scan line 12.

The SRAM driver 4 includes an SRAM control signal generating unit generating control signals for the switches SW-A and SW-B of FIG. 2 and an SRAM inverter power source unit supplying power source voltages to the inverters 16 and 17.

In order to control the SRAM unit 200 during the SRAM drive, the SRAM driver 4 requires YGVDD, YGVSS, SVDD and SVSS. In this case, XVDD of the X driver 2 is unrequired. This is because the graphic data supplied to the data line 11 does not contribute to the SRAM drive. Meanwhile, in this embodiment, YVDD and the like of the Y driver 3 are required during the SRAM driver. This is because, during this period, logic of the shift register is fixed and the potential of the scan line 12 is set at the off level in the Y driver 3. Hence, in this embodiment, only XVDD is unrequired during the SRAM drive. As described above, heretofore, since the XVDD has been supplied also during the SRAM drive, the power loss inside the X driver 2 has been caused.

Next, as embodiments 1 and 2, circuit configurations of DC/DC converters, each constituting the power source voltage generating unit, will be described. The DC/DC converters generate a plurality of power source voltages supplied to the respective drivers. In the embodiments below, description will be made for circuit configurations, in which the XVDD is supplied to the X driver 2.

EMBODIMENT 1

Figure 5:
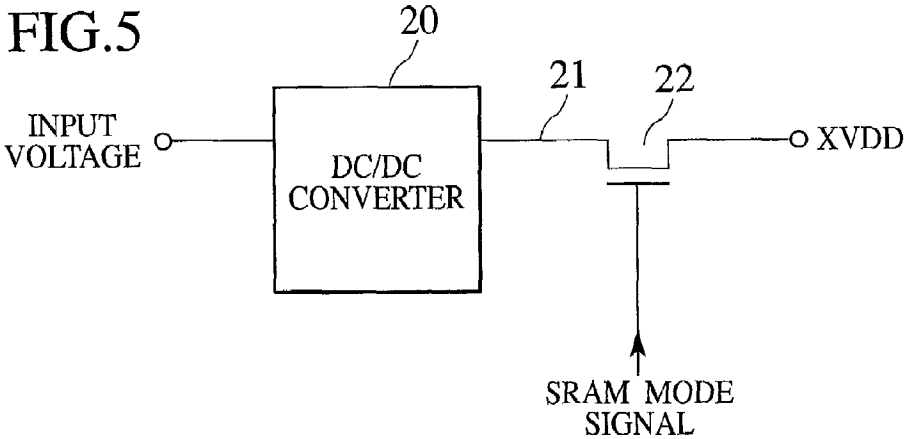
FIG. 5 is a circuit configuration diagram of a DC/DC converter according to an embodiment 1.

FIG. 5 is a circuit configuration diagram of the DC/DC converter according to the embodiment 1, showing a configuration in which the supply of the XVDD is stopped during the SRAM drive.

Pluralities of power supply lines are connected to an output side of the DC/DC converter 20. Among them, to a power supply line 21 connected to the X driver 2, a switching circuit 22 is connected (illustration of the other power supply lines are omitted). This switching circuit 22 is a TFT switch constituted of an n-channel MOSFET, and is the power source voltage control circuit in this embodiment. To a gate of the switching circuit 22, an SRAM mode signal is given from a controller IC (not shown). This SRAM mode signal is a mode-switching signal in this embodiment.

During the normal drive, a high-level SRAM mode signal is supplied from the controller IC (not shown) to the switching circuit 22, where the electric conduction is fixed to be on. In this case, the XVDD generated in the DC/DC converter 20 is outputted from the power supply line 21 via the switching circuit 22 to the X driver 2.

During the SRAM drive, a low-level SRAM mode signal is supplied from the controller IC (not shown) to the switching circuit 22, where the electric conduction is fixed to be off. In this case, since the power supply line 21 is cut off, the XVDD generated in the DC/DC converter 20 is not supplied to the X driver 2.

In the embodiment 1, since the supply of the XVDD to the X driver 2 on standby during the SRAM drive is stopped, an unnecessary power loss in the X driver 2 can be reduced.

Note that, when the switching circuit 22 is constituted of a p-channel MOSFET, the electric conduction of the switching circuit 22 is fixed to be off by the high-level SRAM mode signal.

EMBODIMENT 2

Figure 6:
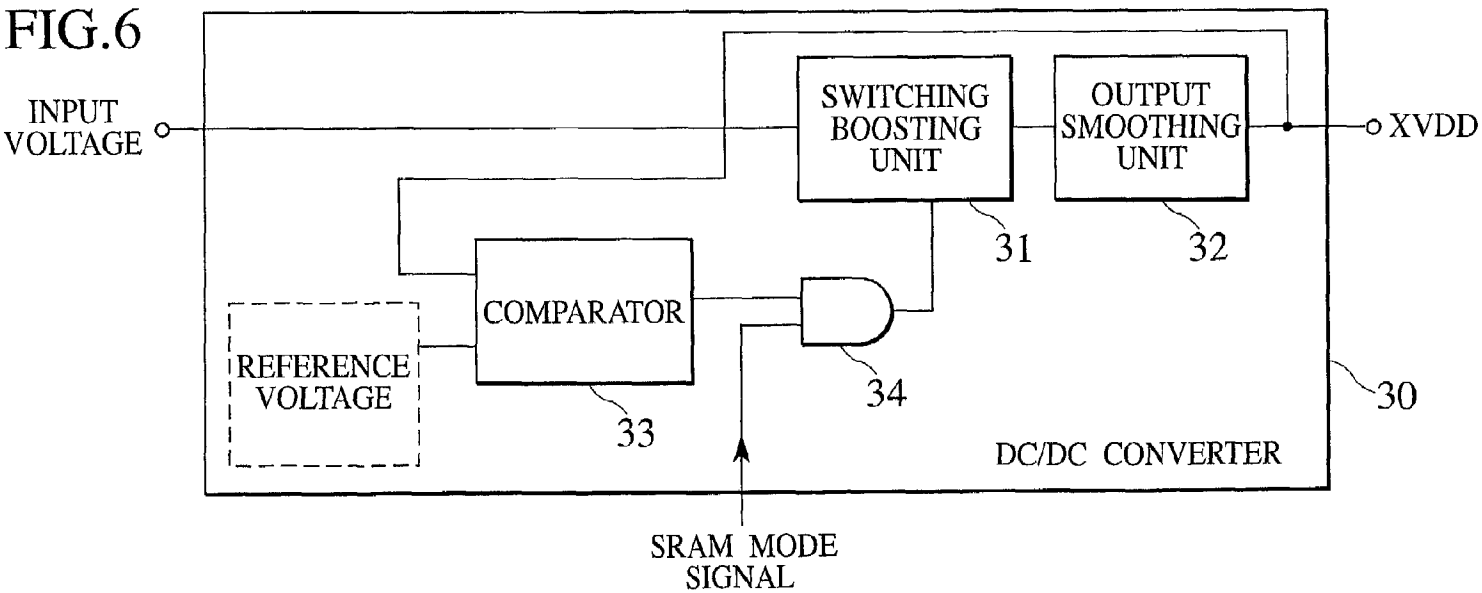
FIG. 6 is a circuit configuration diagram of a DC/DC converter according to an embodiment 2.

FIG. 6 is a circuit configuration diagram of the DC/DC converter according to the embodiment 2, showing a configuration in which the generation of the XVDD is stopped during the SRAM drive.

A DC/DC converter 30 includes a switching boosting unit 31, an output smoothing unit 32, a comparator 33 and an AND circuit 34. Note that, in FIG. 6, among a plurality of circuit configurations generating power source voltages, the circuit configuration generating the XVDD supplied to the X driver 2 is particularly shown.

A voltage inputted to the DC/DC converter 30 is boosted by the switching boosting unit 31, and smoothed by the output smoothing unit 32, then outputted as the XVDD. In the comparator 33, the XVDD outputted from the output smoothing unit 32 is monitored. The comparator 33 compares the XVDD with a reference voltage. If the XVDD reaches the reference voltage, the comparator 33 outputs a low-level signal, and if not, outputs a high-level signal. The boosting operation of the switching boosting unit 31 is controlled by the low-level or high-level signal inputted from the comparator 33 via the AND circuit 34. Thus, the output voltage from the DC/DC converter 30 is always the XVDD.

Note that the AND circuit 34 is a circuit for stopping the generation of the power source voltage in this embodiment. For the AND circuit 34, a comparison result outputted from the comparator 33 and the SRAM mode signal supplied from the controller IC (not shown) are set as input signals. The SRAM mode signal is a mode-switching signal in this embodiment.

During the normal drive, the SRAM mode signal supplied from the controller IC (not shown) to the AND circuit 34 is set at the high level. In this case, since the low-level or high-level signal outputted from the comparator 33 is supplied via the AND circuit 34 to the switching boosting unit 31, the normal boosting operation as described above is carried out in the switching boosting unit 31.

During the SRAM drive, the SRAM mode signal is set at the low level. In this case, whatever an inputted signal may be, the output from the AND circuit 34 is not obtained. Therefore, the boosting operation of the switching boosting unit 31 is stopped, resulting in the stop of the generation of the XVDD.

In the embodiment 2, since the generation of the XVDD in the DC/DC converter 30 is stopped during the SRAM drive, a self-loss of a regulator constituting the DC/DC converter 30 can be eliminated. Thus, the unnecessary power lose in the X driver 2 can be reduced during the SRAM drive, and in addition, the self loss of the regulator constituting the DC/CD converter 30 can be suppressed. Hence, in comparison with the case as the embodiment 1 where only the supply of the XVDD is stopped, the power consumption can be further reduced.

In the above-described embodiments 1 and 2, as shown in FIG. 2, the circuit configuration is premised, in which the scan line 12 of the Y driver 3 also serves as a control line of the switch SW-C of the SRAM unit 200. Therefore, the operation of the Y driver 3 cannot be stopped during the SRAM drive. This is because, in the Y driver 3, the logic of the shift register (not shown) is fixed during the SRAM drive and the potential of the scan line 12 is set at the off level. However, a configuration can be adopted, in which the control of the switch SW-C of the SRAM unit 200 is carried out via a control line dedicated thereto. In the case of adopting the circuit configuration as described above, in which the scan line 12 of the Y driver 3 and the control line of the switch SW-C of the SRAM unit 200 are separated from each other, the operations of the X driver 2 and the Y driver 3 can be stopped during the SRAM drive.

Specifically, in the embodiment 1 shown in FIG. 5, the switching circuit 22 is connected to a power supply line (not shown) connected to the Y driver 3. Moreover, in the embodiment 2, the DC/DC converter generating the YVDD and the like required for driving the Y driver 3 is constituted as shown in FIG. 6.

By adopting the circuit configuration as described above, while the XVDD is supplied to the X driver 2 during the SRAM drive, the supply of the YVDD and the like to the Y driver 3 can be stopped. Hence, the saving of the electric power can be far more achieved.

What is claimed is:

1. A display device comprising:

a memory device-built-in pixel portion including a plurality of data lines and a plurality of scan lines arranged in a matrix, a plurality of pixels disposed on respective intersections of the both lines, a plurality of pixel switching elements electrically conducting the data lines and the pixels based on scan signals supplied to the scan lines to write graphic data supplied to the data lines into the pixels, and a plurality of memory devices storing the graphic data supplied to the data lines and being constituted to be capable of supplying the graphic data stored to the pixels corresponding thereto;

a data driver and a scan driver for controlling the write of the graphic data supplied to the data lines into the pixels in order to perform a first display;

a memory device driver for controlling the write of the graphic data held in the memory devices into the pixels in order to perform a second display;

a power source voltage generating unit for supplying a power source voltage to the data driver and the scan driver; and a power source voltage control circuit for stopping a supply of the power source voltage from the power source voltage generating unit to the data driver during a period of the second display.

2. The display device according to claim 1, wherein the power source voltage control circuit stops the supply of the power source voltage from the power source voltage generating unit to the data driver and the scan driver during the period of the second display.

3. The display device according to claim 1, wherein the power source voltage control circuit is constituted of a TFT switch and electrically disconnects the power source voltage generating unit and the data driver based on a mode switching signal supplied from an external control circuit during the period of the second display.

4. The display device according to claim 2, wherein the power source voltage control circuit is constituted of a TFT switch and electrically disconnects the power source voltage generating unit, the data driver and the scan driver based on a mode switching signal supplied from an external control circuit during the period of the second display.

5. The display device according to claim 1, wherein the power source generating unit is a DC/DC converter.

6. The display device according to claim 1, wherein each of the pixels is a liquid crystal pixel having a liquid crystal layer held between a pixel electrode and an opposite electrode.

7. The display device according to claim 1, wherein each of the memory devices is an SRAM (Static Random Access Memory).

8. The display device according to claim 7, wherein the SRAM includes two inverters and one SRAM switching element.

9. The display device according to claim 1, wherein said first display is based on said graphic data directly received from said data lines, and wherein said second display is based on said graphic data directly received from said memory device.

10. The display device according to claim 1, wherein said data driver and said scan driver are configured to write said graphic data to the pixels without using said memory device nor said memory device driver, and wherein said memory device driver is configured to write said graphic data from said memory device to the pixels corresponding thereto without using said data driver.

11. The display device according to claim 10, wherein said first display is configured to show at least one of a half-tone image, a full-color image or a moving image and said second display is configured to show a still image.

12. The display device according to claim 10, wherein said data driver and said scan driver are configured to write an analog graphic data to the pixels, and said memory device driver is configured to write a binary graphic data to said memory devices.

13. A display device comprising:

a memory device-built-in pixel portion including a plurality of data lines and a plurality of scan lines arranged in a matrix, a plurality of pixels disposed on respective intersections of the both lines, a plurality of pixel switching elements electrically conducting the data lines and the pixels based on scan signals supplied to the scan lines to write graphic data supplied to the data lines into the pixels, and a plurality of memory devices storing the graphic data supplied to the data lines and being constituted to be capable of supplying the graphic data stored to the pixels corresponding thereto;

a data driver and a scan driver for controlling the write of the graphic data supplied to the data lines into the pixels in order to perform a first display;

a memory device driver for controlling the write of the graphic data held in the memory devices into the pixels in order to perform a second display;

a power source voltage generating unit for supplying a power source voltage to the data driver and the scan driver; and a power source voltage generating and stopping circuit for stopping generation of the power source voltage in the power source voltage generating unit to the data driver during a period of the second display.

14. The display device according to claim 13, wherein the power source voltage generating and stopping circuit stops the generation of the power source voltages supplied to the data driver and the scan driver.

15. The display device according to claim 13, wherein the power source voltage generating unit includes a switching boosting unit for boosting an input voltage, an output smoothing unit for smoothing the voltage boosted in the switching boosting unit to set the voltage as an output voltage, a comparator for controlling a boosting operation of the switching boosting unit in response to a comparison result of the output voltage with a reference voltage, and a power source voltage generating and stopping circuit connected between the comparator and the switching boosting unit, and the power source voltage generating and stopping circuit stops the boosting operation in the switching boosting unit by electrically disconnecting the switching boosting unit and the comparator during the period of the second display.

16. The display device according to claim 15, wherein the power source voltage generating and stopping circuit receives the comparison result outputted from the comparator and a mode switching signal supplied from an external control circuit as inputs thereto, and stops a supply of the comparison result to the switching boosting unit in response to a potential level of the mode switching signal.

17. The display device according to claim 16, wherein the power source voltage generating and stopping circuit is constituted of an AND circuit receiving the comparison result outputted from the comparator and the mode switching signal supplied from the external control circuit as input signals thereto, and stops a supply of a comparison result outputted from the comparator to the switching boosting unit during the period of the second display when a potential of the mode switching signal is set at a low level.

18. The display device according to claim 13, wherein the power source voltage generating unit is a DC/DC converter.

19. The display device according to claim 13, wherein each of the pixels is a liquid crystal pixel having a liquid crystal layer held between a pixel electrode and an opposite electrode.

20. The display device according to claim 13, wherein each of the memory devices is an SRAM.

21. The display device according to claim 20, wherein the SRAM includes two inverters and one SRAM switching element.

22. The display device according to claim 13, wherein said first display is based on said graphic data directly received from said data lines, and wherein said second display is based on said graphic data directly received from said memory device.

23. The display device according to claim 13, wherein said data driver and said scan driver are configured to write said graphic data to the pixels without using said memory device nor said memory device driver, and wherein said memory device driver is configured to write said graphic data from said memory device to the pixels corresponding thereto without using said data driver.

24. The display device according to claim 23, wherein said first display is configured to show at least one of a half-tone image, a full-color image or a moving image and said second display is configured to show a still image.

25. The display device according to claim 23, wherein said data driver and said scan driver are configured to write an analog graphic data to the pixels, and said memory device driver is configured to write a binary graphic data to said memory devices.

* * * * *